US011739999B2

(12) United States Patent
Park et al.

(10) Patent No.: US 11,739,999 B2
(45) Date of Patent: Aug. 29, 2023

(54) REFRIGERATOR

(71) Applicant: SAMSUNG ELECTRONICS CO., LTD., Suwon-si (KR)

(72) Inventors: Kyoungki Park, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 238 days.

(21) Appl. No.: 17/218,643

(22) Filed: Mar. 31, 2021

(65) Prior Publication Data

US 2021/0310712 A1 Oct. 7, 2021

(30) Foreign Application Priority Data

Apr. 7, 2020 (KR) ..... 10-2020-0042348

(51) Int. Cl.
*F25C 1/04* (2018.01)
*F25C 5/182* (2018.01)

(52) U.S. Cl.
CPC ..... *F25C 1/04* (2013.01); *F25C 5/182* (2013.01)

(58) Field of Classification Search
CPC ..... F25C 2700/02; F25C 1/04; F25C 5/187; F25C 5/182
See application file for complete search history.

(56) References Cited

U.S. PATENT DOCUMENTS

| | | | | |
|---|---|---|---|---|
| 6,050,097 | A * | 4/2000 | Nelson | F25C 5/187 62/344 |
| 2021/0180850 | A1* | 6/2021 | Ishimizu | F25C 1/246 |

FOREIGN PATENT DOCUMENTS

| | | | |
|---|---|---|---|
| CN | 101949623 | | 5/2012 |
| EP | 0504735 | | 5/1995 |
| JP | 2543098 | | 8/1997 |
| JP | 2007-71467 | | 3/2007 |
| JP | 2010-65961 | A | 3/2010 |
| KR | 20-1989-0019629 (1993-000447 | | 10/1989 |
| KR | 1993-0004478 | Y1 | 7/1993 |
| KR | 20-0110445 | | 10/1993 |
| KR | 0169439 | B1 | 1/1999 |
| KR | 2000-0014607 | A | 3/2000 |
| KR | 10-0346401 | | 8/2002 |
| KR | 10-0671567 | | 1/2007 |
| KR | 10-2008-0037477 | A | 4/2008 |
| KR | 10-1645356 | | 8/2016 |
| KR | 10-2017-0126164 | A | 11/2017 |
| KR | 2002-0012442 | A | 2/2022 |

OTHER PUBLICATIONS

International Search Report dated Aug. 3, 2021 in International Application No. PCT/KR2021/004128.

* cited by examiner

*Primary Examiner* — Elizabeth J Martin
(74) *Attorney, Agent, or Firm* — STAAS & HALSEY LLP

(57) ABSTRACT

A refrigerator including an ice making tray in which ice is generated, an ice bucket to store ice separated from the ice making tray, a full ice detection lever to rotate toward the ice bucket to detect whether the ice bucket is fully filled with ice, a manipulation lever manipulated outside the ice maker to move between a first position and a second position, and a stopper to rotate in conjunction with the movement of the manipulation lever and interfere with the rotation of the full ice detection lever.

11 Claims, 12 Drawing Sheets

REFRIGERATOR

CROSS-REFERENCE TO RELATED APPLICATION(S)

This application is based on and claims priority under 35 U.S.C. § 119 to Korean Patent Application No. 10-2020-0042348, filed on Apr. 7, 2020, in the Korean Intellectual Property Office, the disclosure of which is incorporated by reference herein in its entirety.

BACKGROUND

1. Field

The disclosure relates to a refrigerator including an ice maker, and more particularly, to a refrigerator including an ice maker having an improved structure to manually perform an ice making function.

2. Description of the Related Art

In general, a refrigerator is a device that cools and stores food using a refrigeration cycle consisting of a compressor, a condenser, an expansion valve, and an evaporator, and an ice maker that generates ice may be provided in the refrigerator.

The ice maker includes an ice making tray in which ice is generated, an ejector to discharge ice from the ice making tray, an ice bucket to store ice discharged from the ice making tray, and a controller to control an ice making process, thereby automatically generating ice.

In addition, the ice maker includes a full ice detection member to detect whether the ice bucket is full of ice to determine whether to make additional ice.

While an ice making function of the ice maker may be turned on and off using a display provided outside the refrigerator or a separate switch installed inside the ice maker, when there is no display in the refrigerator or no switch in the ice maker, the ice maker may not be turned on and off by the need of a user, regardless of whether the ice bucket is full of ice or not.

SUMMARY in accordance with an aspect of the disclosure, a refrigerator includes an ice making tray in which ice is generated, an ice bucket configured to store ice separated from the ice making tray, a full ice detection lever configured to rotate toward the ice bucket to detect whether the ice bucket is fully filled with ice, a manipulation lever configured to be manipulated outside the ice maker, and a stopper configured to rotate in conjunction with the movement of the manipulation lever and interfere with the rotation of the full ice detection lever.

The refrigerator may further include a cover on which the manipulation lever is movably mounted, wherein the cover may include a locking protrusion extending from an inner surface of the cover to fix the position of the manipulation lever by interfering with the manipulation lever.

The manipulation lever may include a locking part formed by being bent from one end thereof to be interfered with by the locking protrusion.

The manipulation lever may be configured to be movable with respect with the cover between a first position in which the locking part is not interfered with by the locking protrusion and a second position in which the locking part is interfered with by the locking protrusion.

The manipulation lever may be connected to an elastic member mounted on the cover to be restored to the first position by an elastic restoring force of the elastic member when the locking part is separated from the locking protrusion.

When the manipulation lever is in the second position, the stopper may be in a position that interferes with the rotation of the full ice detection lever.

The refrigerator may further include a fixing frame coupled to an inner side of the cover to fix each arrangement state by accommodating the manipulation lever and a portion of the stopper.

The fixing frame may include a movement limiting rib extending toward the manipulation lever to limit a movement range of the manipulation lever when the manipulation lever is pressed from the outside to release the manipulation lever from the locking protrusion.

The fixing frame may include at least one guide rib extending toward the manipulation lever to guide the movement of the manipulation lever with respect to the cover to press an upper surface of the manipulation lever.

The cover may include a shaft protrusion extending from the inner surface of the cover, and the stopper may include an insertion hole into which the shaft protrusion is inserted to rotate around the shaft protrusion.

The manipulation lever may include a body seated on the inner surface of the cover, and a connection protrusion extending from the body to be connected to the stopper.

The stopper may further include a connection portion provided to insert the connection protrusion of the manipulation lever, and as the manipulation lever moves, the stopper may rotate around the shaft protrusion.

The manipulation lever may include a knob extending from the body to be exposed to the outside of the cover.

The stopper may include a connection portion provided to be connected to the manipulation lever, a shaft portion provided to be connected to the cover, and an interference portion provided to come into contact with the full ice detection lever.

The stopper may include a protrusion rib protruding from one end thereof to prevent separation of the full ice detection lever when interfering with the full ice detection lever.

In accordance with an aspect of the disclosure, a refrigerator includes an ice making tray in which ice is generated, an ice bucket located below the ice making tray to store ice separated from the ice making tray, a full ice detection lever configured to rotate toward the ice bucket to detect whether the ice bucket is fully filled with ice, a cover provided in front of the full ice detection lever, a manipulation lever mounted to be linearly movable with respect to the cover between a first position and a second position, and a stopper configured to rotate according to the movement of the manipulation lever, the stopper rotating to interfere with the rotation of the full ice detection lever when the manipulation lever is in the second position.

The cover may include a locking protrusion extending from an inner surface of the cover to fix the second position of the manipulation lever by interfering with the manipulation lever.

The stopper may include a protrusion rib protruding from one end thereof to prevent separation of the full ice detection lever when interfering with the full ice detection lever.

In accordance with an aspect of the disclosure; a refrigerator includes a housing having an opening, an ice bucket configured to store ice inside the housing, an ice making tray configured to generate ice and to be rotatable to drop the ice into the ice bucket, a full ice detection lever configured to rotate toward the ice bucket to detect whether the ice bucket is fully filled with ice, a cover configured to cover the opening of the housing, a manipulation lever movably mounted on the cover, and a stopper configured to rotate in conjunction with the movement of the manipulation lever and rotatably mounted on the cover to interfere with the rotation of the full ice detection lever.

The stopper may include a protrusion rib protruding upward to prevent left and right separation of the full ice detection lever when interfering with the full ice detection lever.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another.

For example, without departing from the scope of the disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

It is an aspect of the disclosure to provide a refrigerator having an improved structure so that an ice making function may be manually turned on and off from the outside using a manipulation lever.

Hereinafter, embodiments of the disclosure will be described in detail with reference to the accompanying drawings.

Figure 1:
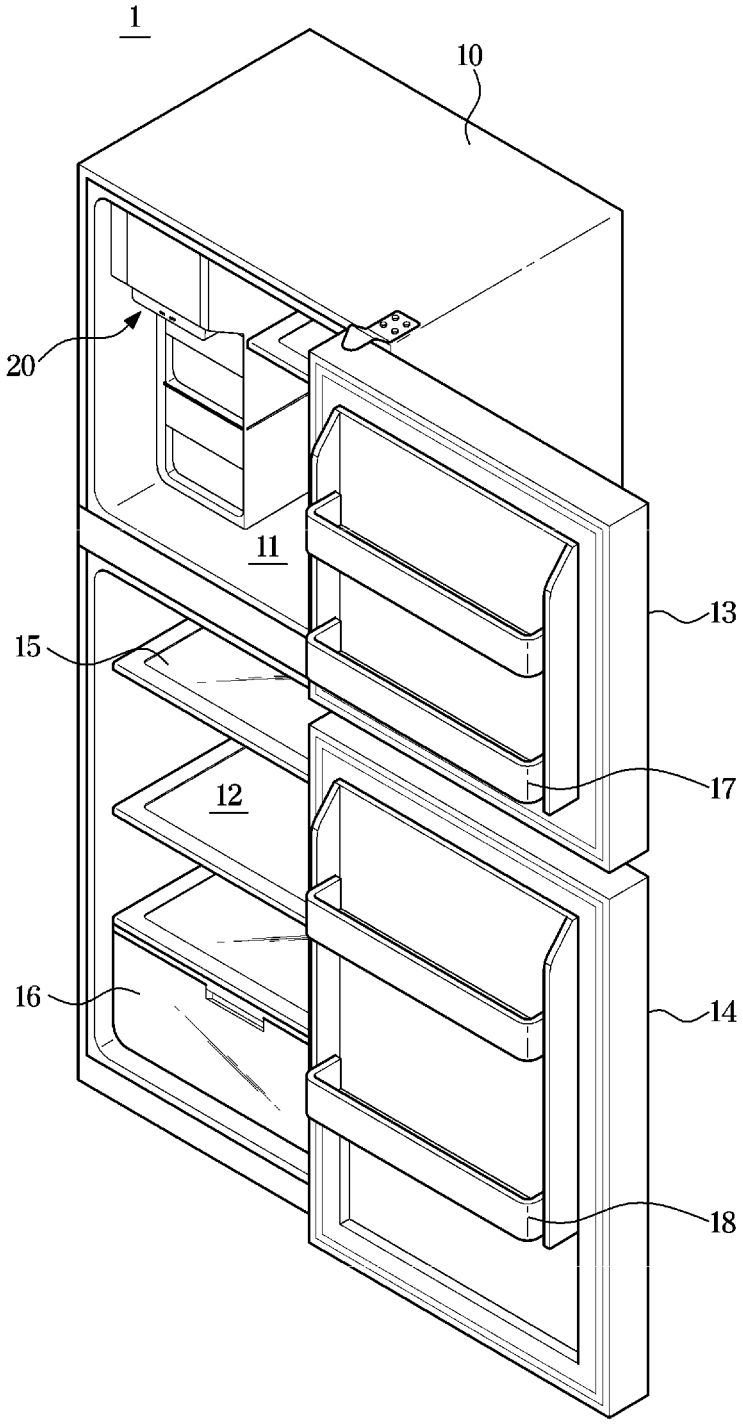
FIG. 1 is a view illustrating a refrigerator according to an embodiment of the disclosure.

FIG. 1 is a view illustrating a refrigerator according to an embodiment of the disclosure.

Referring to FIG. 1, a refrigerator 1 includes a main body 10, a storage compartment provided inside the main body 10, and a door to open and close the storage compartment. For reference, the refrigerator 1 according to an embodiment of the disclosure is a TMF type refrigerator 1 in which a freezing compartment 11 is provided at an upper portion and a refrigerating compartment 12 is provided at a lower portion, but the disclosure is not limited to such a TMF type refrigerator, and may be applied to various types of refrigerators, such as a double door refrigerator, a BMF refrigerator, an FDR refrigerator, and a for door refrigerator.

The storage compartment may be divided up and down by a horizontal partition such that the freezing compartment 11 is provided at an upper portion of the main body 10 and the refrigerating compartment 12 is provided at a lower portion of the main body 10.

At least one shelf 15 to place food or an object may be installed inside the refrigerating compartment 12. In addition, a storage container 16 to store fresh food, etc. may be provided at a lower end of the storage compartment.

The refrigerating compartment 12 may be opened and closed by a refrigerating compartment door 14, and the refrigerating compartment door 14 may be rotatably mounted on the main body 10. The refrigerating compartment door 14 opens and closes an open front of the refrigerating compartment 12. The refrigerating compartment door 14 is hinged to the main body 10 to be rotatable forward.

The freezing compartment 11 may be opened and closed by a freezing compartment door 13, and the freezing compartment door 13 may be rotatably mounted on the main body 10. The freezing compartment door 13 opens and closes an open front of the freezing compartment 11. The freezing compartment door 13 is hinged to the main body 10 to be rotatable forward.

A door guard 17 to store objects may be installed on an inner surface of the freezing compartment door 13, and a door guard 18 may be installed on an inner surface of the refrigerating compartment door 14. Each of the door guards 17 and 18 may be provided in plural.

The inside of the refrigerator 1 is cooled by a refrigeration cycle to be maintained in a low temperature state. Although not specifically illustrated, the refrigeration cycle may be configured to independently supply a refrigerant to the refrigerating compartment 12 and the freezing compartment 11. The refrigerator 1 includes a compressor to compress the refrigerant and a condenser to condense the compressed refrigerant, and the refrigerant condensed in the condenser may be supplied along a flow path.

An ice maker 20 to generate ice using cold air in the freezing compartment 11 may be mounted on one side of the freezing compartment 11. Details of the ice maker 20 will be described later.

Figure 2:
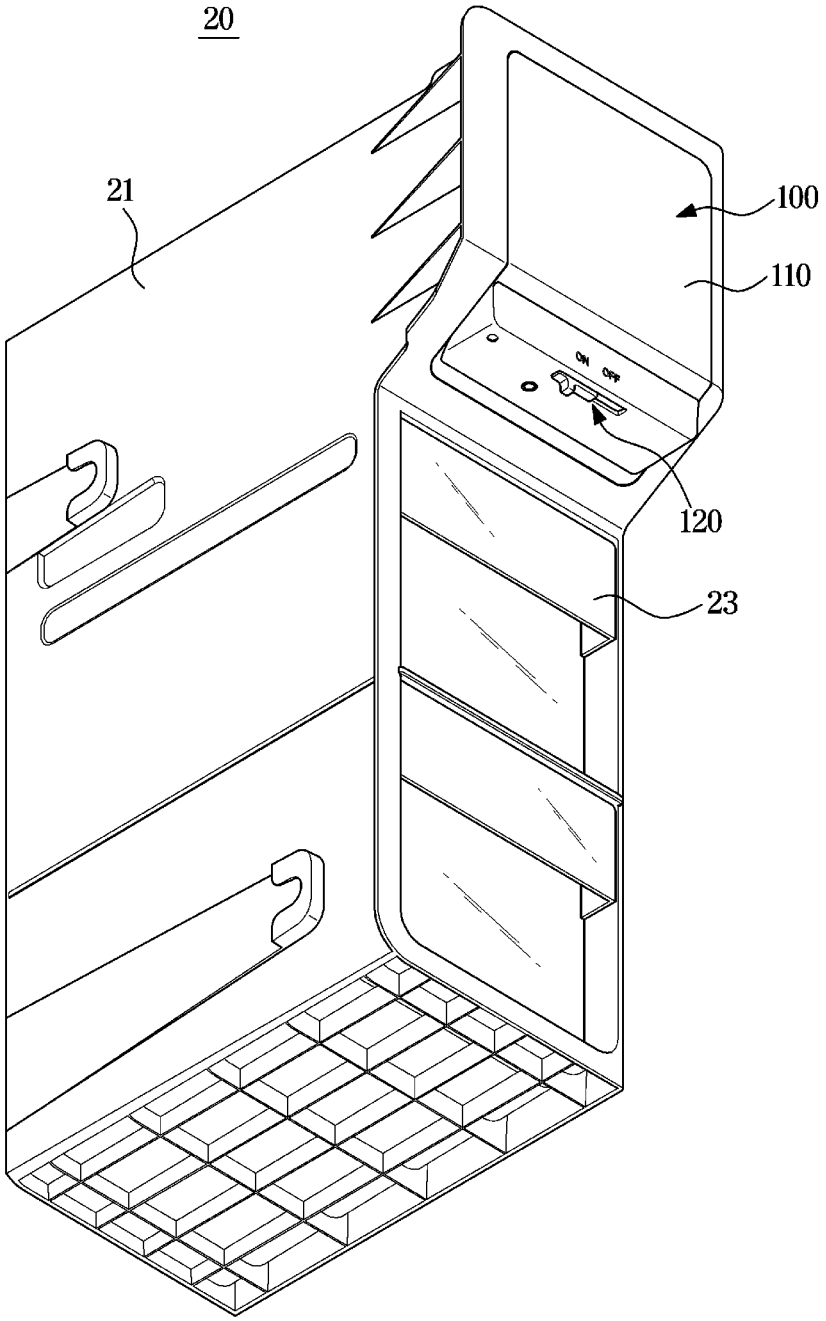
FIG. 2 is a view illustrating an ice maker of the refrigerator according to an embodiment of the disclosure.
Figure 3:
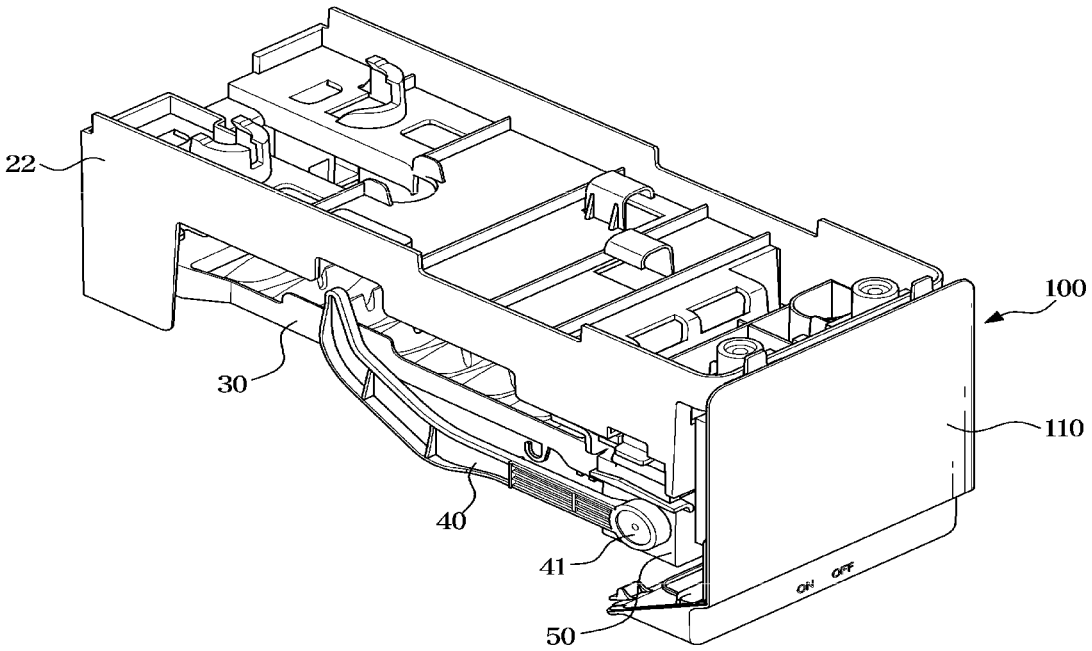
FIG. 3 is a view illustrating main components in the ice maker of the refrigerator according to an embodiment of the disclosure.

FIG. 2 is a view illustrating an ice maker of the refrigerator according to an embodiment of the disclosure, and FIG. 3 is a view illustrating main components in the ice maker of the refrigerator according to an embodiment of the disclosure.

Referring to FIGS. 2 and 3, the ice maker 20 may include a housing 21 forming an exterior and an ice bucket 23 accommodated in the housing 21.

The housing 21 may be formed as a rectangular structure with an empty inside. An ice making tray 30, a driving frame 50, and a full ice detection lever 40 may be accommodated on an upper side of the housing 21, and a cover 110 covering the above components from the front and quipped with a manipulation lever 120, which will be described later, may be coupled. An ice bucket 23 is provided below the housing 21 to accommodate and store ice falling from the ice making tray 30.

The ice bucket 23 may have a substantially box shape with an open top to accommodate and store ice separated from the ice making tray 30. The ice bucket 23 may be provided below the ice making tray 30. FIG. 2 illustrates that two of the ice buckets 23 are provided, but the number thereof is not limited thereto.

A support frame 22 may be accommodated on the upper side of the housing 21. The ice making tray 30 may be coupled to the support frame 22 to be rotatable with respect to the support frame 22.

The ice making tray 30 and the full ice detection lever 40 may be connected to the driving frame 50. The full ice detection lever 40 may be coupled to the driving frame 50 to be rotatable toward the ice bucket 23 about a rotating part 41.

The driving frame 50 includes a driving motor (not shown) to rotate the ice making tray 30. The driving frame 50 may be connected to a rotation shaft of the ice making tray 30. The driving motor (not shown) inside the driving frame 50 may rotate the ice making tray 30 with respect to the support frame 22 and the driving frame 50.

The full ice detection lever 40 to detect whether ice stored in the ice bucket 23 below the ice making tray 30 is full may be mounted on the driving frame 50.

The ice making tray 30 is provided with a plurality of ice making cells having a semicircular shape in which ice is generated by receiving water supplied from the outside through a water supply pipe. The ice making tray 30 may be made of a plastic material that may be well twisted in order to separate ice in each of the ice making cells. However, the material thereof is not limited thereto.

Specifically, the ice making tray 30 may be provided to be rotated by the driving motor (not shown) inside the driving frame 50. The rotation shaft of the ice making tray 30 may extend from the ice making tray 30 in a front-rear direction of the ice maker 20. In this case, the direction in which the ice making tray 30 rotates is a direction in which the plurality of ice making cells provided in the ice making tray 30 rotates to face the ice bucket 23 below the ice making tray 30.

When the ice making tray 30 is rotated by the driving motor (not shown) at a certain angle or more, the rotation of the ice making tray 30 may be restricted by a locking protrusion (not shown) formed on the support frame 22. In this case, one side of the ice making tray 30 is continuously rotated by the driving motor (not shown), and the other side opposite to one side is restricted by the locking protrusion (not shown). In this embodiment, one side of the ice making tray 30 is a side where the ice making tray 30 and the driving frame 50 are coupled, and the other side is a side where the ice making tray 30 and the support frame 22 are connected. Accordingly, the ice making tray 30 is twisted with respect to an axial direction, so that ice may be separated from the plurality of ice making cells of the ice making tray 30. Therefore, ice generated in the ice making tray 30 may fall into the ice bucket 23 provided below the ice making tray 30 as the ice making tray 30 is rotated and twisted.

However, when the ice making tray 30 does not rotate more than the certain angle, the locking protrusion (not shown) formed on the support frame 22 do not act, so that the ice making tray 30 is not twisted.

In addition, the ice making tray 30 may not be rotated so that the plurality of ice making cells of the ice making tray 30 face the ice bucket 23 below the ice making tray 30, so that ice may not be separated from the ice making tray 30, and thus the ice does not fall into the ice bucket 23 provided below the ice making tray 30.

The ice making tray 30 may be connected to the full ice detection lever 40 within the driving frame 50 so that when a rotation angle of the full ice detection lever 40 is limited, a rotation angle of the ice tray 30 may be also limited.

Specifically, when ice is fully filled in the ice bucket 23, the full ice detection lever 40 may come into contact with the ice and the rotation angle thereof may be limited. In this case, the full ice detection lever 40 may not be rotated by the ice thereunder, or may be rotated at a certain angle.

Accordingly, because the ice making tray 30 is not rotated by the certain angle or more as the full ice detection lever 40 does not rotate, or rotates at an angle smaller than the maximum angle at which the full ice detection lever 40 rotates when ice is not fully filled in the ice bucket 23, ice may not be separated from the ice making tray 30 as described above. Therefore, ice may be not added to the ice bucket 23, and an ice making function of the ice maker 20 may be turned off.

A manipulation assembly 100 may be provided in front of the support frame 22, the ice making tray 30, the driving frame 50, and the full ice detection lever 40. An insulating material 170 (see FIG. 10) may be provided at the rear of the cover 110 of the manipulation assembly 100. However, the position of the manipulation assembly 100 may not be limited thereto.

The cover 110 may be provided to be connected to the ice bucket 23. The cover 110 and the ice bucket 23 may be integrally formed or may be connected as separate components.

The manipulation assembly 100 may be configured to turn off the ice making function as in a case where ice is fully filled in the ice bucket 23 by mechanically interrupting the rotation of the full ice detection lever 40 through a manual manipulation of a user from the outside of the ice maker 20. Details of the manipulation assembly 100 will be described later.

Figure 4:
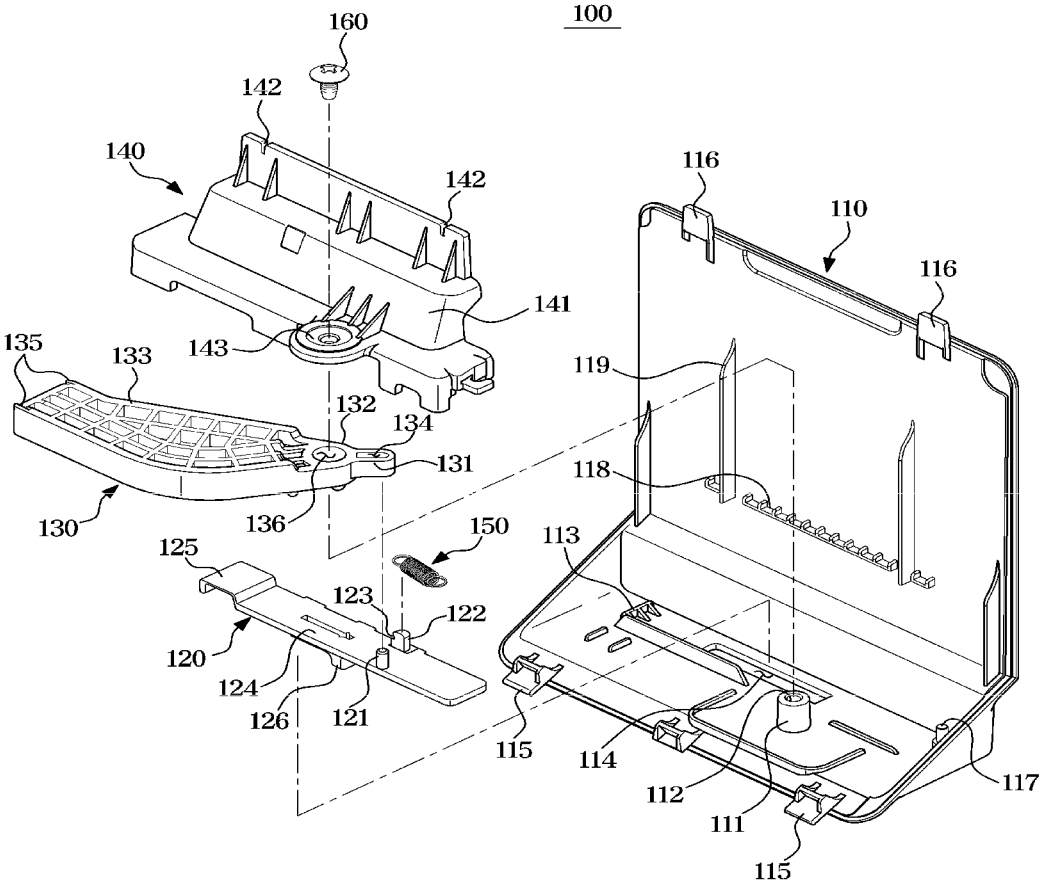
FIG. 4 is a view illustrating a manipulation assembly of the refrigerator according to an embodiment of the disclosure as viewed from a rear side.

FIG. 4 is a view illustrating a manipulation assembly of the refrigerator according to an embodiment of the disclosure as viewed from a rear side.

Referring to FIG. 4, the manipulation assembly 100 includes the cover 110, the manipulation lever 120, a stopper 130, and a fixing frame 140.

The manipulation lever 120 may be movably mounted on the cover 110. The cover 110 may include a knob passing hole 114 so that a knob 126 of the manipulation lever 120 passes therethrough and is exposed to the outside. The knob passing hole 114 may be formed by being cut on a lower surface of the cover 110.

The manipulation lever 120 may be moved by being manipulated from the outside. Specifically, the knob 126 of the manipulation lever 120 may be manipulated from the outside. The manipulation lever 120 may be movably mounted to on the cover 110.

The cover 110 may include a locking protrusion 113 to fix the position of the manipulation lever 120 by interfering with the manipulation lever 120. The locking protrusion 113 may be provided to extend from an inner surface of the cover 110. The locking protrusion 113 may be provided to extend upward from the lower surface of the cover 110.

The cover 110 may also include a first elastic member mounting part 117 extending from the inner surface of the cover 110. One end of an elastic member 150, which will be described later, is fixed to the first elastic member mounting part 117 so that the manipulation lever 120 and the cover 110 may be elastically coupled.

The manipulation lever 120 may include a body 124 seated on the inner surface of the cover 110, the knob 126 exposed by extending outward from one surface of the body 124, and a connection protrusion 121 extending inward from the other surface opposite to the one surface of the body 124.

The knob 126 may be provided to be gripped by a user from the outside. The connection protrusion 121 may be provided so that the manipulation lever 120 is connected to the stopper 130. The manipulation lever 120 may also include a locking part 125 provided by being bent from one end thereof to be interfered with by the locking protrusion 113 of the cover 110. Specifically, the locking part 125 may be formed to be caught on the locking protrusion 113 by being bent in a substantially U shape from one end of the body 124.

The manipulation lever 120 may also include a second elastic member mounting part 122 extending inward from the body 124. The other end of the elastic member 150, which will be described later, is fixed to the second elastic member mounting part 122 so that the manipulation lever 120 and the cover 110 may be elastically coupled. A mounting groove 123 may be formed on the second elastic member mounting part 122 so that the elastic member 150 may be fixed.

The cover 110 may include a shaft protrusion 111 extending from the inner surface of the cover 110. Specifically, the shaft protrusion 111 may be formed to extend upward from a bottom surface of the cover 110. The cover 110 and the stopper 130 may be connected by the shaft protrusion 111.

The stopper 130 may include a connection portion 131, a shaft portion 132, and an interference portion 133. The stopper 130 may be coupled to the cover 110 to be rotatable about the shaft portion 132. The connection portion 131 may extend to one side of the shaft portion 132 to connect the manipulation lever 120 and the stopper 130. The interference portion 133 may extend to the other side of the shaft portion 132 to come into contact with the full ice detection lever 40.

The shaft portion 132 of the stopper 130 may include a first insertion hole 136 so that the shaft protrusion 111 of the cover 110 is inserted therein. The connection portion 131 of the stopper 130 may include a second insertion hole 134 so that the connection protrusion 121 of the manipulation lever 120 is inserted therein. The interference portion 133 of the stopper 130 may be formed in a shape having a plurality of passing holes so that a strength thereof may be secured while a weight thereof is reduced. Accordingly, the material cost may be reduced.

The fixing frame 140 may be coupled to the inside of the cover 110 to accommodate the manipulation lever 120 and a portion of the stopper 130 to fix the respective arrangement states. The fixing frame 140 may include a body 141 forming an overall appearance and a fastening member coupling part 143 to which a fastening member 160 is coupled. A plurality of slits 142 is formed on the fixing frame 140 so that when the cover 110 and the fixing frame 140 are disposed, the fixing frame 140 may be fitted to slit coupling parts 119 of the cover 110.

The cover 110 may also include at least one coupling hook 115 and coupling guide 116. The at least one coupling guide 116 is formed on one side of the cover 110 so that the position of the cover 110 may be guided when the cover 110 is coupled to the housing 21. In addition, the at least one coupling hook 115 is formed on the other side of the cover 110 so that the cover 110 and the housing 21 may be coupled.

Hereinafter, a coupling relationship between the cover 110, the manipulation lever 120, the stopper 130, and the fixing frame 140 will be described.

The cover 110 is connected to the manipulation lever 120, the stopper 130, and the fixing frame 140 so that the above components may be coupled to the inner surface of the cover.

The manipulation lever 120 may be mounted to be movable left and right with respect to the cover 110. Herein, the left and right movement refers to a direction in which the manipulation lever 120 approaches or moves away from the locking protrusion 113 of the cover 110, which will be described later. Or, the left and right movement refers to a direction perpendicular to the front-rear direction and the vertical direction of the ice maker 20. Specifically, the manipulation lever 120 may be mounted on a front side of the cover 110. The knob 126 of the manipulation lever 120 may be exposed to the outside of the cover 110 by passing through the knob passing hole 114 of the cover 110.

The stopper 130 may be rotatably mounted in a direction of getting close to the full ice detection lever 40 or in a direction of getting away from the full ice detection lever 40 around the shaft protrusion 111 of the cover 110. The shaft protrusion 111 of the cover 110 is inserted into the first insertion hole 136 provided on the shaft portion 132 of the stopper 130 so that the stopper 130 may be rotated around the shaft protrusion 111.

The connection protrusion 121 of the manipulation lever 120 may be inserted into the second insertion hole 134 provided on the connection portion 131 of the stopper 130. Through this structure, as the manipulation lever 120 moves left and right with respect to the cover 110, the stopper 130 may rotate around the shaft portion 132. That is, in conjunction with the movement of the manipulation lever 120, the stopper 130 may rotate in the direction of getting close to the full ice detection lever 40 or in the direction of getting away from the full ice detection lever 40 around the shaft protrusion 111.

The cover 110 may include the first elastic member mounting part 117, and the manipulation lever 120 may include the second elastic member mounting part 122. One end of the elastic member 150 is fixed to the first elastic member mounting part 117 and the other end of the elastic member 150 is fixed to the second elastic member mounting part 122, so that the manipulation lever 120 may be coupled to be elastically movable with respect to the cover 110.

The cover 110 may include the locking protrusion 113, and the manipulation lever 120 may include the locking part 125 that is interfered with by the locking protrusion 113. When the manipulation lever 120 moves in a direction of getting close to the locking protrusion 113, the locking part 125 of the manipulation lever 120 is caught on the locking protrusion 113 of the cover 110. In this embodiment, this may be that the manipulation lever 120 moves from the left to the right with respect to the cover 110. In this case, the elastic member 150 is in a state of being extended by the movement of the manipulation lever 120, so that an elastic restoring force is applied to the manipulation lever 120.

Thereafter, when the locking part 125 of the manipulation lever 120 is released from the locking protrusion 113 of the cover 110, the manipulation lever 120 may return to its initial state by the elastic restoring force of the elastic member 150. Details related to the movement of the manipulation lever 120 with respect to the cover 110 will be described later.

The fixing frame 140 may be coupled to the inside of the cover 110 to accommodate the manipulation lever 120 and a portion of the stopper 130 to fix the arrangement state of the manipulation lever 120 and the stopper 130. Specifically, the fixing frame 140 may be mounted above the manipulation lever 120 and the stopper 130.

The cover 110 may include a fixing frame support part 118 extending inward. The fixing frame support part 118 may provisionally fix the arrangement of the fixing frame 140 in the cover 110. In addition, as the slit coupling parts 119 of the cover 110 are inserted into the slits 142 formed on the fixing frame 140, the arrangement of the fixing frame 140 in the cover 110 may be provisionally fixed.

The fixing frame 140 may include the fastening member coupling part 143. The fastening member coupling part 143 may be formed at a position corresponding to the shaft protrusion 111 of the cover 110. The fastening member coupling part 143 may also be formed at a position corresponding to the first insertion hole 136 formed on the shaft portion 132 of the stopper 130. A coupling groove 112 to allow the fastening member 160 to be coupled may be formed on the shaft protrusion 111 of the cover 110.

Therefore, the separate fastening member 160 may pass through the fixing frame 140, the stopper 130, and the cover 110 to combine the above components into one configuration. Through this structure, the entire manipulation assembly 100 may be combined.

Figure 5:
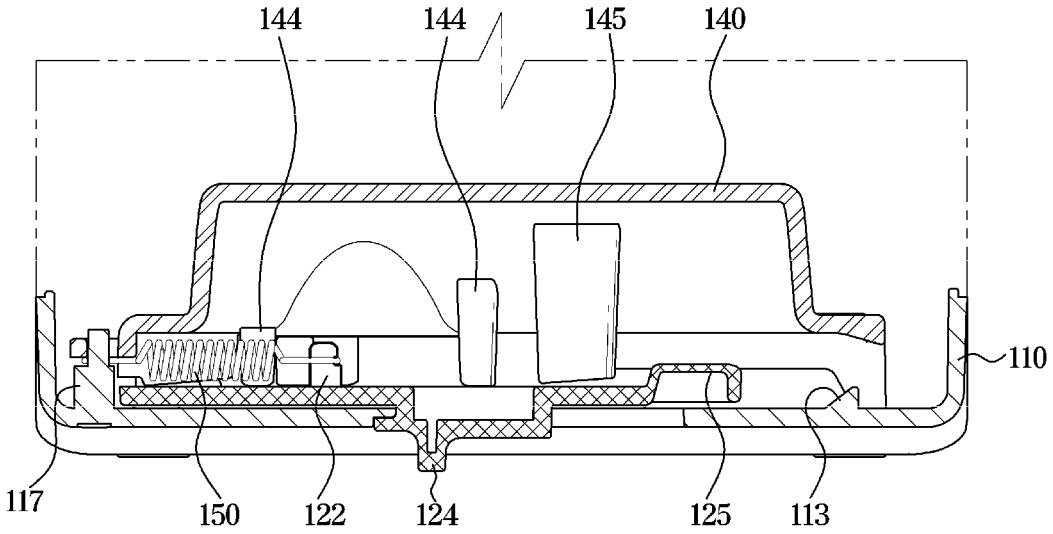
FIG. 5 is a cross-sectional view of a manipulation lever of the refrigerator according to an embodiment of the disclosure when in a turn-on state.
Figure 6:
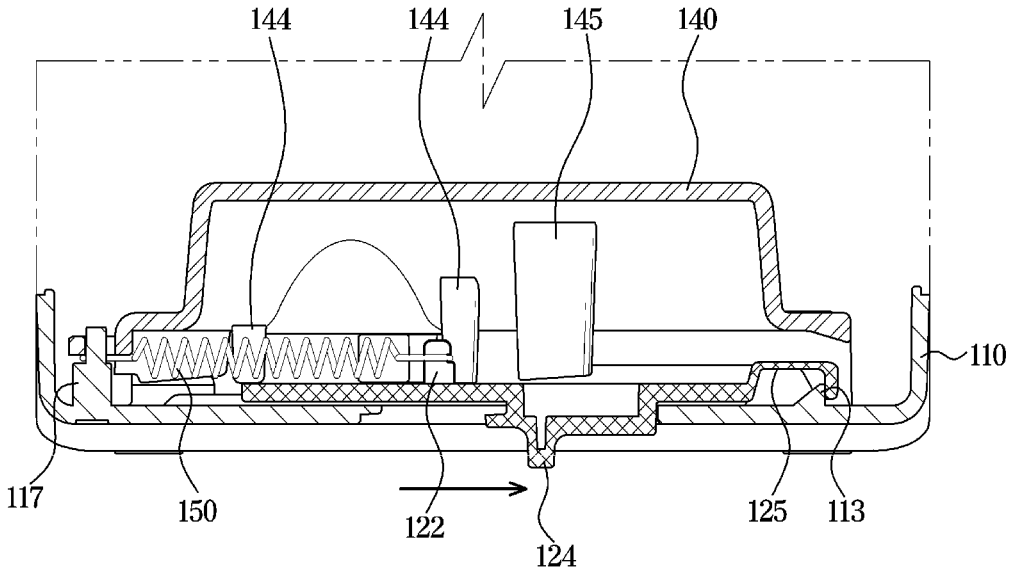
FIG. 6 is a cross-sectional view of the manipulation lever of the refrigerator according to an embodiment of the disclosure when in a turn-off state.
Figure 7:
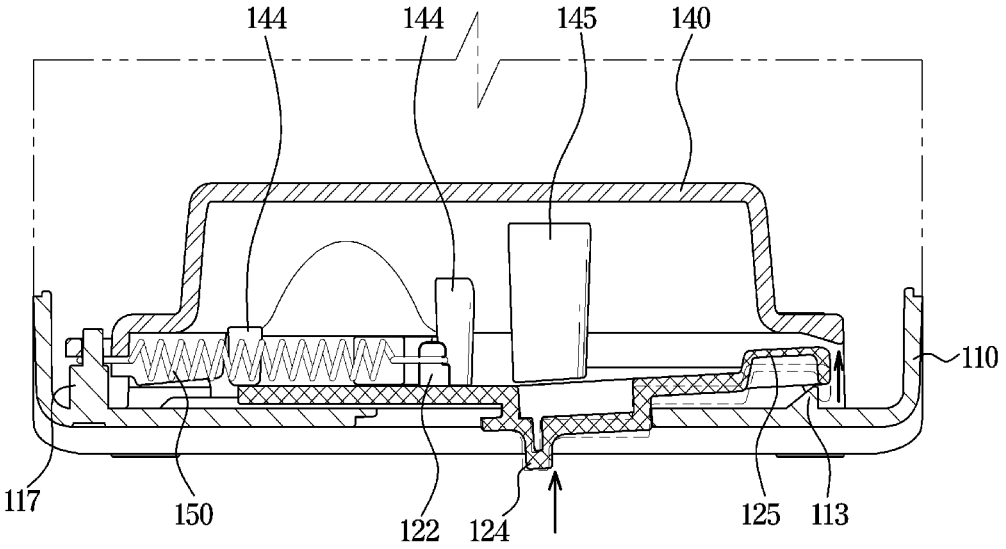
FIG. 7 is a cross-sectional view of the manipulation lever of the refrigerator according to an embodiment of the disclosure when released from the turn-off state.

FIG. 5 is a cross-sectional view of a manipulation lever of the refrigerator according to an embodiment of the disclosure when in a turn-on state. FIG. 6 is a cross-sectional view of the manipulation lever of the refrigerator according to an embodiment of the disclosure when in a turn-off state. FIG. 7 is a cross-sectional view of the manipulation lever of the refrigerator according to an embodiment of the disclosure when released from the turn-off state.

As illustrated in FIG. 5, a position when the manipulation lever 120 is in a turn-on state, that is, a position where the locking part 125 of the manipulation lever 120 is not interfered with by the locking protrusion 113 of the cover 110 may be referred to as a first position.

Also, as illustrated in FIG. 6, a position when the manipulation lever 120 is in a turn-off state, that is, a position where the locking part 125 of the manipulation lever 120 is interfered with by the locking protrusion 113 of the cover 110 may be referred to as a second position.

Accordingly, the manipulation lever 120 may be provided to be movable in the left-right direction with respect to the cover 110 and may be provided to be movable between the first position and the second position.

Referring to FIG. 5, when the manipulation lever 120 of the refrigerator 1 is in the turn-on state, the manipulation lever 120 is in the first position. In this case, the manipulation lever 120 is in a state of being moved to the left of the cover 110.

In this case, one end of the elastic member 150 is fixed to the first elastic member mounting part 117 of the cover 110, and the other end of the elastic member 150 is fixed to the second elastic member mounting part 122 of the manipulation lever 120. In this case, no force may be applied to the elastic member 150.

The fixing frame 140 may also include at least one guide rib 144. The manipulation lever 120 is provided to be movable left and right of the cover 110, and thus the guide rib 144 to press an upper surface of the manipulation lever 120 may be formed to guide the left and right movement of the manipulation lever 120.

Specifically, the guide rib 144 may extend downward from the inner surface of the fixing frame 140 toward the manipulation lever 120, Through the structure of the guide rib 144, the manipulation lever 120 may move in the left-right direction of the cover 110 in parallel with the bottom surface of the cover 110 when moving. Therefore, a user may easily move the manipulation lever 120 between the first position and the second position.

Referring to FIG. 6, the user may switch the manipulation lever 120 from the turn-on state to the turn-off state. In this case, the manipulation lever 120 moves from the first position to the second position. In this case, the manipulation lever 120 moves from the left to the right with respect to the cover 110.

When the user moves the manipulation lever 120 from the first position to the second position, the manipulation lever 120 moves along an inclined surface of the locking protrusion 113. In this case, the locking part 125 of the manipulation lever 120 is finally interfered by the locking protrusion 113 of the cover 110.

In this case, one end of the elastic member 150 is fixed to the first elastic member mounting part 117 of the cover 110, and the other end of the elastic member 150 is fixed to the second elastic member mounting part 122 of the manipulation lever 120. As the manipulation lever 120 moves to the second position, the elastic member 150 is changed from the original state to the extended state. In this case, the elastic restoring force of the elastic member 150 is applied to the manipulation lever 120.

Referring to FIG. 7, when attempting to turn-on the ice making function by moving the manipulation lever 120 from the turn-off state to the turn-on state, the user may press the knob 126 of the manipulation lever 120 upward.

When the knob 126 of the manipulation lever 120 is pressed upward, the locking part 125 of the manipulation lever 120 formed integrally therewith is also lifted upward so that the locking part 125 of the manipulation lever 120 may be separated from the locking protrusion 113 of the cover 110.

When the manipulation lever 120 is in the second position, the elastic member 150 is in a state of being extended by the movement of the manipulation lever 120, so that the elastic restoring force to restore the manipulation lever 120 to the first position is applied to the manipulation lever 120.

Accordingly, the user may release a locked state of the manipulation lever 120 by slightly pressing the knob 126 of the manipulation lever 120 upward. When the manipulation lever 120 is separated from the locking protrusion 113, the manipulation lever 120 may be restored to the first position again by the elastic restoring force of the elastic member 150. Accordingly, the manipulation lever 120 returns from the turn-of state to the turn-on state, so that the ice making function may be turned-on. In this case, the manipulation lever 120 moves from the right to the left with respect to the cover 110.

The fixing frame 140 may also include a movement limiting rib 145 to limit an upward movement range of the manipulation lever 120 when the manipulation lever 120 is pressed.

The movement limiting rib 145 may support an inner side of the manipulation lever 120 so that when the user presses the manipulation lever 120 upward, the knob 126 does not excessively enter the inside of the cover 110 as the manipulation lever 120 excessively moves upward.

Figure 8:
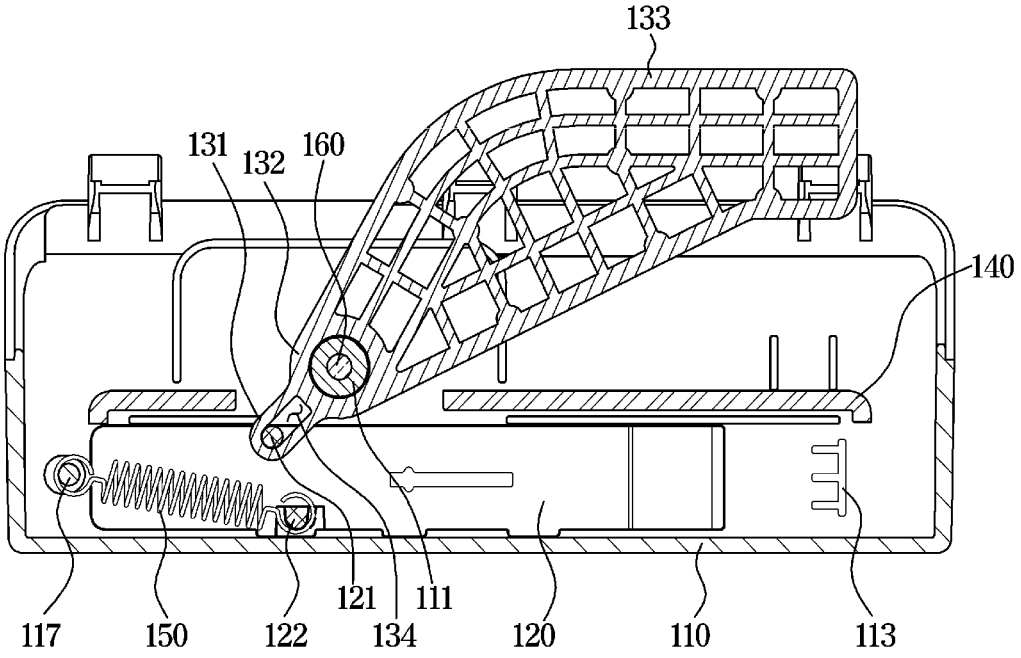
FIG. 8 is a top perspective view of the manipulation lever of the refrigerator according to an embodiment of the disclosure when in the turn-on state.
Figure 9:
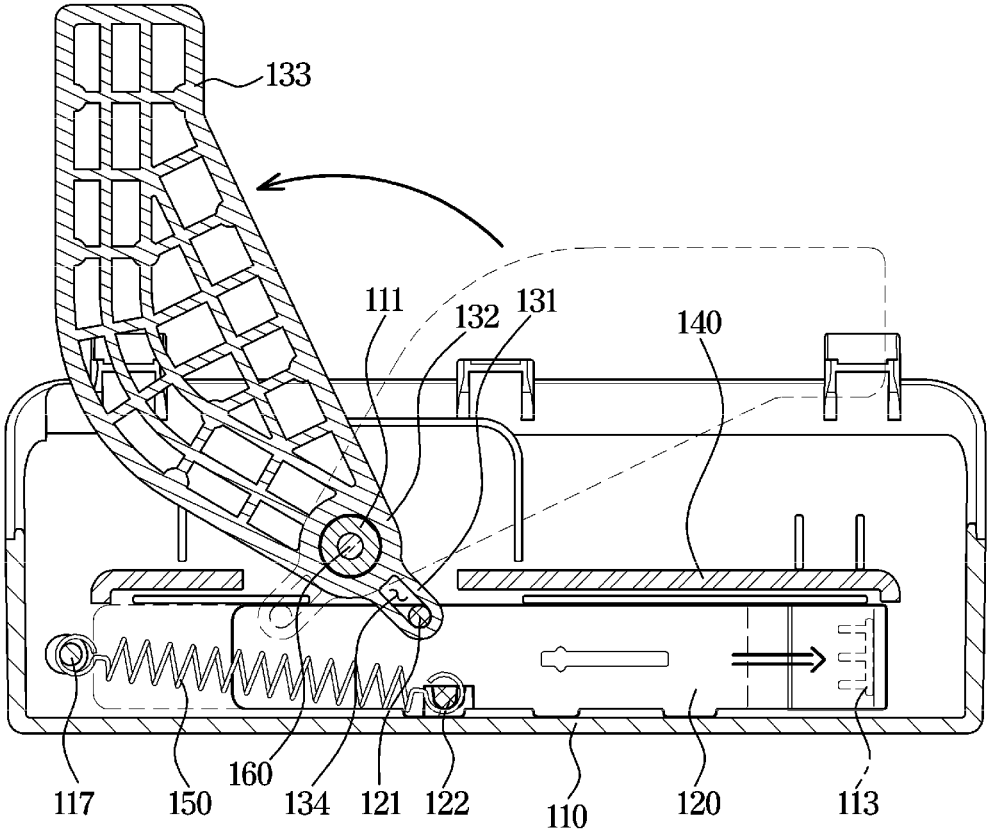
FIG. 9 is a top perspective view of the manipulation lever of the refrigerator according to an embodiment of the disclosure when in the turn-off state.

FIG. 8 is a top perspective view of the manipulation lever of the refrigerator according to an embodiment of the disclosure when in the turn-on state, and FIG. 9 is a top perspective view of the manipulation lever of the refrigerator according to an embodiment of the disclosure when in the turn-off state.

Referring to FIG. 8, the stopper 130 may be connected to the connection protrusion 121 of the manipulation lever 120 to be rotatably mounted around the shaft protrusion 111 of the cover 110. When the manipulation lever 120 is in the turn-on state, that is, when the manipulation lever 120 is in the first position, the interference portion 133 of the stopper 130 may be located closest to the cover 110. In other words, when the manipulation lever 120 is in the first position, the interference portion 133 of the stopper 130 is in a state of being located farthest from the full ice detection lever 40.

As illustrated in FIG. 9, when the manipulation lever 120 moves from the turn-on state to the turn-off state, that is, when the manipulation lever 120 moves from the first position to the second position, the interference portion 133 of the stopper 130 may be located farthest from the cover 110. In other words, when the manipulation lever 120 is in the second position, the interference portion 133 of the stopper 130 is in a state of being located closest to the full ice detection lever 40.

As the manipulation lever 120 moves from the first position to the second position, the connection protrusion 121 of the manipulation lever 120 presses the connection portion 131 of the stopper 130 in a moving direction of the manipulation lever 120. In the case of FIG. 9, because the manipulation lever 120 moves from the left to the right of the cover 110, the connection portion 131 of the stopper 130 also moves from the left to the right of the cover 110.

Because the connection portion 131 and the interference portion 133 of the stopper 130 are positioned at opposite sides around the shaft portion 132, as the connection portion 131 rotates from the left to the right of the cover 110, the interference portion 133 of the stopper 130 rotates from the right to the left of the cover 110. That is, the entire stopper 130 rotates counterclockwise.

Accordingly, as the manipulation lever 120 moves from the turn-on state, which is the first position, to the turn-off state, which is the second position, the stopper 130 rotates counterclockwise around the shaft portion 132. A relationship between the stopper 130 and the full ice detection lever 40 according to the rotation of the stopper 130 will be described later.

Figure 10:
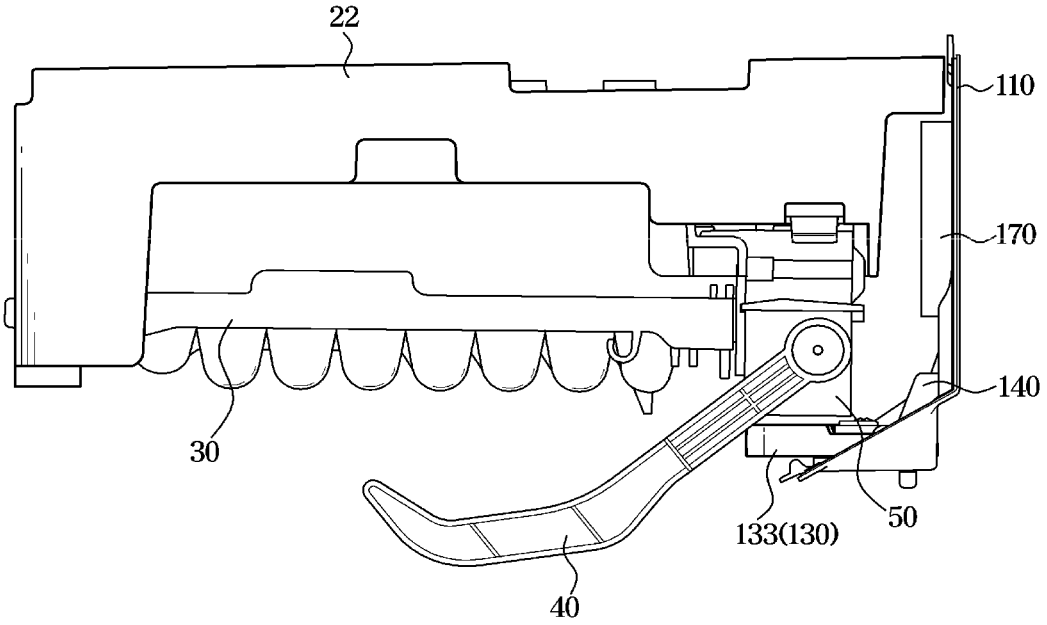
FIG. 10 is a side view illustrating a state of a full level detection lever when the manipulation lever of the refrigerator according to an embodiment of the disclosure is in the turn-on state.
Figure 11:
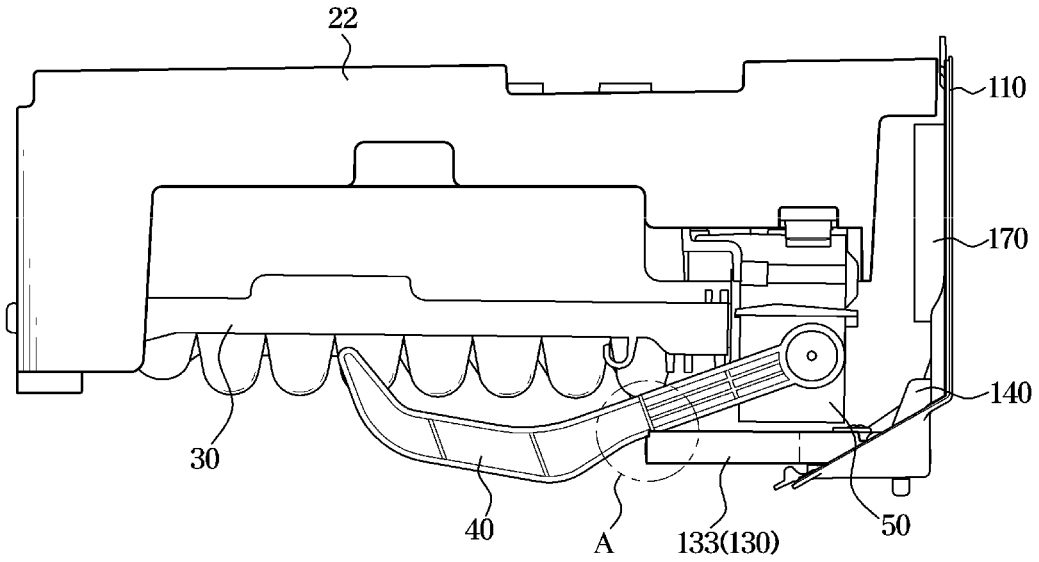
FIG. 11 is a side view illustrating a state of the full level detection lever when the manipulation lever of the refrigerator according to an embodiment of the disclosure is in the turn-off state.

FIG. 10 is a side view illustrating a state of a full level detection lever when the manipulation lever of the refrigerator according to an embodiment of the disclosure is in the turn-on state, and FIG. 11 is a side view illustrating a state of the full level detection lever when the manipulation lever of the refrigerator according to an embodiment of the disclosure is in the turn-off state.

Referring to FIG. 10, when the manipulation lever 120 is in a turn-on state, the stopper 130 and the full ice detection lever 40 may not come into contact with each other. In this case, the rotation of the full ice detection lever 40 may not be interfered with by the stopper 130.

As described above with reference to FIGS. 2 and 3, when the rotation of the full ice detection lever 40 is not interfered and the full ice detection lever 40 rotates at the maximum angle, the ice making tray 30 may also rotate at the certain angle or more without the influence of the full ice detection lever 40.

Accordingly, the ice making tray 30 rotates and is twisted to separate ice from the ice making tray 30 so that the ice may be supplied to the ice bucket 23 below the ice making tray 30.

Referring to FIG. 11, when the manipulation lever 120 is in the turn-off state, the stopper 130 may rotate counterclockwise to interfere the rotation of the full ice detection lever 40.

Through this, the rotation angle of the full ice detection lever 40 may be limited by the stopper 130 as in the case when the ice bucket 23 is fully filled with ice, regardless of whether the ice bucket 23 is actually fully filled with ice.

In addition, because as the rotation of the full ice detection lever 40 is limited, the rotation of the ice making tray 30 is also limited, the ice making tray 30 is not twisted by rotation, so that ice is not supplied to the ice bucket 23. Furthermore, new ice is not generated, so that the ice making function may be maintained in the turn-off state.

This embodiment illustrates and describes that the full ice detection lever 40 is coupled to the left of the driving frame 50, and the manipulation lever 120 is in the turn-on state when the manipulation lever 120 is moved to the left of the cover 110, and is in the turn-off state when the manipulation lever 120 is moved on the right of the cover 110.

However, this embodiment is not limited thereto, and in a case where the full ice detection lever 40 is coupled to the right of the driving frame 50, the manipulation lever 120 may be in the turn-on state when the manipulation lever 120 is moved to the right of the cover 110, and may be in the turn-off state when the manipulation lever 120 is moved on the left of the cover 110. In this case, when the manipulation lever 120 moves from the right to the left of the cover 110, the stopper 130 rotates in a clockwise direction.

Figure 12:
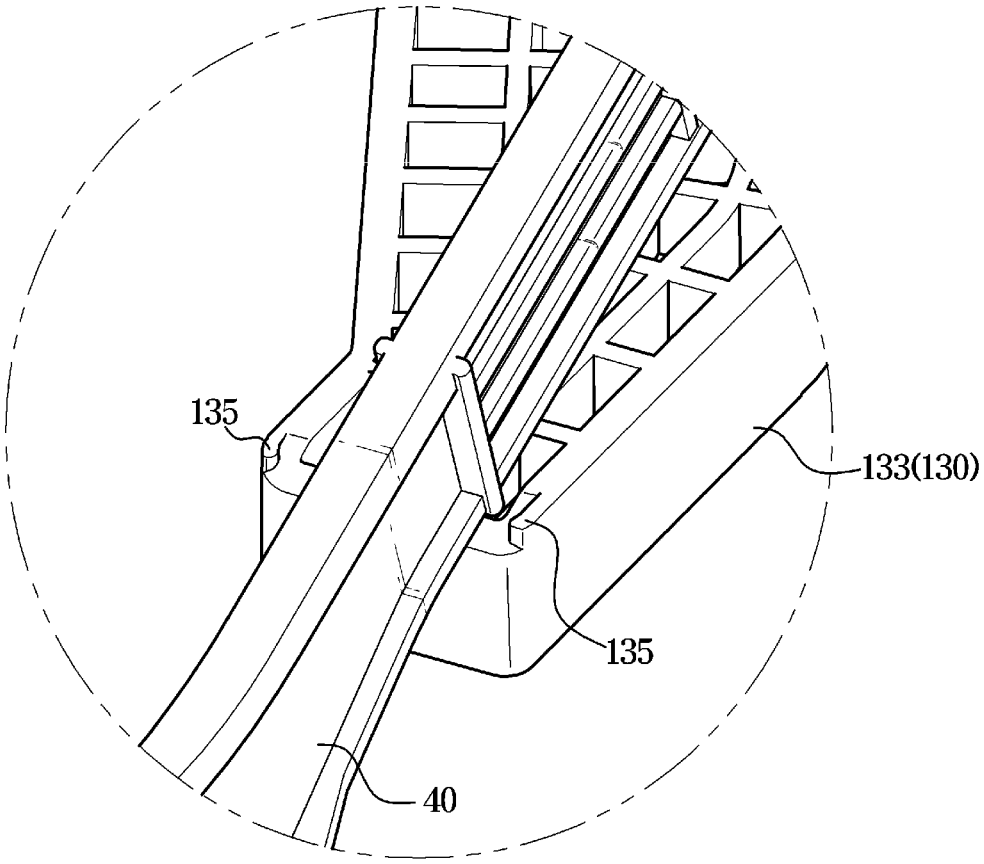
FIG. 12 is an enlarged perspective view of part A in FIG. 11.

FIG. 12 is an enlarged perspective view of part A in FIG. 11.

Referring to FIG. 12, the stopper 130 may include a pair of protrusion ribs 135. When the manipulation lever 120 is in the turn-off state as illustrated in FIG. 11, as described above, the stopper 130 may hinder and interfere with the rotation of the full ice detection lever 40. In this case, the stopper 130 may include the pair of protrusion ribs 135 in order to prevent the full ice detection lever 40 from being separated from a side of the stopper 130.

The pair of protrusion ribs 135 may be formed to protrude from one end of the stopper 130. Through this structure, the full ice detection lever 40 may be prevented from being separated from the side of the stopper 130.

The ice maker 20 according to the disclosure may be simply turned on and off manually from the outside by changing and mounting only the manipulation assembly 100 in the configuration of a conventional ice maker.

As is apparent from the above, according to the disclosure, an ice making function can be turned on and off outside an ice maker with only a simple manipulation using a manipulation lever.

Further, according to the disclosure, the rotation of a full level detection lever can be mechanically interfered even without installing a separate display or controller.

Although the technical idea of the disclosure has been described above with reference to specific embodiments, the scope of rights of the disclosure is not limited to these embodiments. It will be understood by those skilled in the art that various changes in form and details may be made therein without departing from the spirit and scope of the disclosure as defined by the appended claims and their equivalents.

What is claimed is:

1. A refrigerator comprising:

a freezing compartment;

an ice making tray disposed in the freezing compartment, the ice making tray in which ice is formed;

an ice bucket disposed in the freezing compartment, the ice bucket configured to store the ice after the ice is separated from the ice making tray;

a full ice detection lever configured to rotate toward the ice bucket to detect whether the ice bucket is fully filled with the ice stored in the ice bucket;

a manipulation lever configured to be manipulated from an outside of an ice maker which includes the ice bucket;

a stopper configured to rotate in conjunction with a movement of the manipulation lever when the manipulation lever is manipulated and interfere with a rotation of the full ice detection lever toward the ice bucket;

a cover on which the manipulation lever is mounted, the manipulation lever being moveable; and an elastic member having one end fixed to the cover and another end fixed to the manipulation lever;

wherein the cover comprises a locking protrusion formed to extend from an inner surface of the cover to fix a position of the manipulation lever by interfering with the manipulation lever, wherein the manipulation lever comprises a locking part having one end formed to be bent to be interfered with by the locking protrusion, and wherein the manipulation lever is configured to be movable in a left-right direction with respect to the cover between a first position in which the locking part is not interfered with by the locking protrusion and a second position in which the locking part is interfered with by the locking protrusion, and the manipulation lever is configured to be restored to the first position from the second position by an elastic restoring force of the elastic member when the locking part is separated from the locking protrusion.

2. The refrigerator according to claim 1, wherein the stopper is in a position that interferes with the rotation of the full ice detection lever when the manipulation lever is in the second position.

3. The refrigerator according to claim 1, further comprising a fixing frame coupled to an inner side of the cover to fix each arrangement state by accommodating the manipulation lever and a portion of the stopper.

4. The refrigerator according to claim 3, wherein the fixing frame comprises a movement limiting rib that is formed to extend toward the manipulation lever to limit a movement range of the manipulation lever when the manipulation lever is pressed from the outside of the ice maker to release the manipulation lever from the locking protrusion.

5. The refrigerator according to claim 3, wherein the fixing frame comprises at least one guide rib that is formed to extend toward the manipulation lever to guide the movement of the manipulation lever with respect to the cover to press an upper surface of the manipulation lever.

6. The refrigerator according to claim 1, wherein the cover comprises a shaft protrusion that is formed to extend from the inner surface of the cover, and the stopper comprises an insertion hole into which the shaft protrusion is inserted to rotate around the shaft protrusion.

7. The refrigerator according to claim 6, wherein the manipulation lever comprises a body seated on the inner surface of the cover, and a connection protrusion that is formed to extend from the body to be connected to the stopper.

8. The refrigerator according to claim 7, wherein the stopper further comprises:

a connection portion provided for the connection protrusion of the manipulation lever to be inserted, and the stopper rotates around the shaft protrusion as the manipulation lever moves.

9. The refrigerator according to claim 7, wherein the manipulation lever comprises a knob that is formed to extend from the body to be exposed to an outside of the cover.

10. The refrigerator according to claim 8, wherein the stopper comprises:

a connection portion provided to be connected to the manipulation lever, a shaft portion provided to be connected to the cover, and an interference portion provided to come into contact with the full ice detection lever.

11. The refrigerator according to claim 1, wherein the stopper comprises:

a protrusion rib that is formed to protrude from one end thereof to prevent separation of the full ice detection lever when interfering with the full ice detection lever.

* * * * *